US012741356B2

(12) United States Patent
Chang et al.

(10) Patent No.: US 12,741,356 B2
(45) Date of Patent: Sep. 22, 2026

(54) THERMAL IMAGING SURFACE PROCESSING AUXILIARY SYSTEM AND METHOD

(71) Applicant: INDUSTRIAL TECHNOLOGY RESEARCH INSTITUTE, Hsinchu (TW)

(72) Inventors: Hsin-Chang Chang, Taichung City (TW); Chu-Kai Huang, Erlin Township (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 371 days.

(21) Appl. No.: 18/529,893

(22) Filed: Dec. 5, 2023

(65) Prior Publication Data

US 2025/0144770 A1 May 8, 2025

(30) Foreign Application Priority Data

Nov. 3, 2023 (TW) ..... 112142423

(51) Int. Cl.
*B24B 49/14* (2006.01)
*B24B 49/00* (2012.01)
*B24B 51/00* (2006.01)

(52) U.S. Cl.
CPC ..... *B24B 49/14* (2013.01); *B24B 49/006* (2013.01); *B24B 51/00* (2013.01)

(58) Field of Classification Search
CPC ..... B24B 49/14; B24B 49/006; B24B 51/00; B24B 37/015
See application file for complete search history.

(56) References Cited

U.S. PATENT DOCUMENTS 5,174,068 A * 12/1992 Pickert ..... G01B 7/16 451/10
2004/0029500 A1 2/2004 Saitoh et al.
(Continued)

FOREIGN PATENT DOCUMENTS

CN 102275131 B 3/2013
CN 108000249 B 11/2019
(Continued)

OTHER PUBLICATIONS

TW Office Action dated Sep. 25, 2024 in application 112142423.
(Continued)

*Primary Examiner* — Eldon T Brockman
(74) *Attorney, Agent, or Firm* — Maschoff Brennan

(57) ABSTRACT

A thermal imaging surface processing auxiliary system applicable for apparatus using a grinding tool to perform surface processing, includes a thermal imaging sensor and a computing device. The thermal imaging sensor photographs at least one of the grinding tool and the workpiece to generate thermal image. The computing device obtains a temperature change of an observation area in the thermal image. When the temperature change is not greater than a preset critical value, the computing device controls the apparatus to move the grinding tool toward the workpiece at a speed greater than a preset processing speed. When the temperature change is greater than the preset critical value, the computing device controls the apparatus to move the grinding tool toward the workpiece at the preset processing speed, wherein the observation area corresponds to a portion other than the contact portion between the grinding tool and the workpiece.

6 Claims, 9 Drawing Sheets

(56) References Cited

U.S. PATENT DOCUMENTS

| | | | | |
|---|---|---|---|---|
| 2004/0200816 | A1 | 10/2004 | Chung et al. | |
| 2020/0001427 | A1 | 1/2020 | Soundararajan et al. | |
| 2021/0178547 | A1 | 6/2021 | Corsi et al. | |
| 2023/0057196 | A1 * | 2/2023 | Chuang | G06T 7/74 |
| 2025/0144770 | A1 * | 5/2025 | Chang | B24B 49/14 |

FOREIGN PATENT DOCUMENTS

| | | | | | |
|---|---|---|---|---|---|
| CN | 111512425 | B | | 8/2020 | |
| CN | 111002103 | B | | 4/2021 | |
| CN | 111157119 | B | * | 8/2021 | G08B 17/125 |
| JP | 2018024040 | A | * | 2/2018 | |
| JP | 2020203375 | A | | 12/2020 | |
| KR | 102114359 | B1 | | 5/2020 | |
| TW | 1662386 | B | | 6/2019 | |
| TW | 202112492 | A | | 4/2021 | |
| TW | 202224848 | A | * | 7/2022 | B24B 47/20 |
| TW | 1789926 | B | | 1/2023 | |
| TW | 202308785 | A | | 3/2023 | |
| TW | 202331434 | A | | 8/2023 | |

OTHER PUBLICATIONS

Chia-Hsuan Shen "Acoustic emission based grinding wheel wear monitoring: Signal processing and feature extraction" Applied Acoustics 196 (2022) 108863, Jun. 16, 2022.

Guodi et al., "Laser-assisted Rapid Polishing Technology for Silicon Carbide Wafers", Feb. 2022, Laser and Additive Manufacturing Technology Album.

Zhou et al., "Numerical and experimental studies on the temperature field in precision grinding of SiCp/Al composites" Int J Adv Manuf Technol (2013) 67:1007-1014, Oct. 16, 2012.

Lin Mingxian "Silicon Wafer Semiconductor (6th edition)" Silicon wafer semiconductor materials technology.

* cited by examiner

THERMAL IMAGING SURFACE PROCESSING AUXILIARY SYSTEM AND METHOD

CROSS-REFERENCE TO RELATED APPLICATIONS

This non-provisional application claims priority under 35 U.S.C. § 119(a) on Patent Application No(s). 112142423 filed in Republic of China (ROC) on Nov. 3, 2023, the entire contents of which are hereby incorporated by reference.

BACKGROUND

1. Technical Field

This disclosure relates to a thermal imaging surface processing auxiliary system and method.

2. Related Art

Grinding, polishing and other processes are performed by controlling the abrasive tool to be processed in a line or surface manner, so it is not easy to accurately measure the distance between the abrasive tool (such as grinding wheels and other consumables) and the workpiece. In order to avoid collision and excessive extrusion between the grinding tool and the workpiece, it is usually necessary to reserve a stroke between the abrasive tool and the workpiece. The main purpose of grinding and polishing is surface optimization. The amount of grinding and polishing should be reduced as much as possible to reduce the increase in processing time and the increase in the use of grinding slurry, grinding fluid and consumables caused by the additional grinding. Therefore, how to shorten unnecessary processing time and reduce the usage of consumables is a problem pending to be solved in this technical field.

SUMMARY

According to one or more embodiment of this disclosure, a thermal image surface processing auxiliary system is applicable for a surface processing apparatus that uses a grinding tool to perform surface processing on at least one workpiece. The thermal image surface processing auxiliary system includes a thermal imaging sensor and a computing device. The thermal imaging sensor is configured to photograph at least one of the grinding tool and the at least one workpiece to generate at least one thermal image. The computing device is connected to the thermal imaging sensor and is configured to obtain a temperature change of an observation area in the at least one thermal image. When the temperature change is not greater than a preset critical value, the computing device controls the surface processing apparatus to move the grinding tool toward the at least one workpiece at a speed greater than a preset processing speed. When the temperature change is greater than the preset critical value, the computing device controls the surface processing apparatus to move the grinding tool toward the at least one workpiece at the preset processing speed, wherein the observation area corresponds to a portion other than a contact portion of the grinding tool with the at least one workpiece.

According to one or more embodiment of this disclosure, a thermal imaging surface processing auxiliary method is applicable for a surface processing apparatus that uses a grinding tool to perform surface processing on at least one workpiece. The thermal imaging surface processing auxiliary method includes executed by a computing device: obtaining at least one thermal image generated by a thermal imaging sensor photographing at least one of the grinding tool and the at least one workpiece; obtaining a temperature change of an observation area in the at least one thermal image; controlling the surface processing apparatus to move the grinding tool toward the at least one workpiece at a speed greater than a preset processing speed when the temperature change is not greater than a preset critical value; and controlling the surface processing apparatus to move the grinding tool toward the at least one workpiece at the preset processing speed when the temperature change is greater than the preset critical value, wherein the observation area corresponds to a portion other than a contact portion of the grinding tool with the at least one workpiece.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. According to the description, claims and the drawings disclosed in the specification, one skilled in the art may easily understand the concepts and features of the present invention. The following embodiments further illustrate various aspects of the present invention, but are not meant to limit the scope of the present invention.

Figure 1:
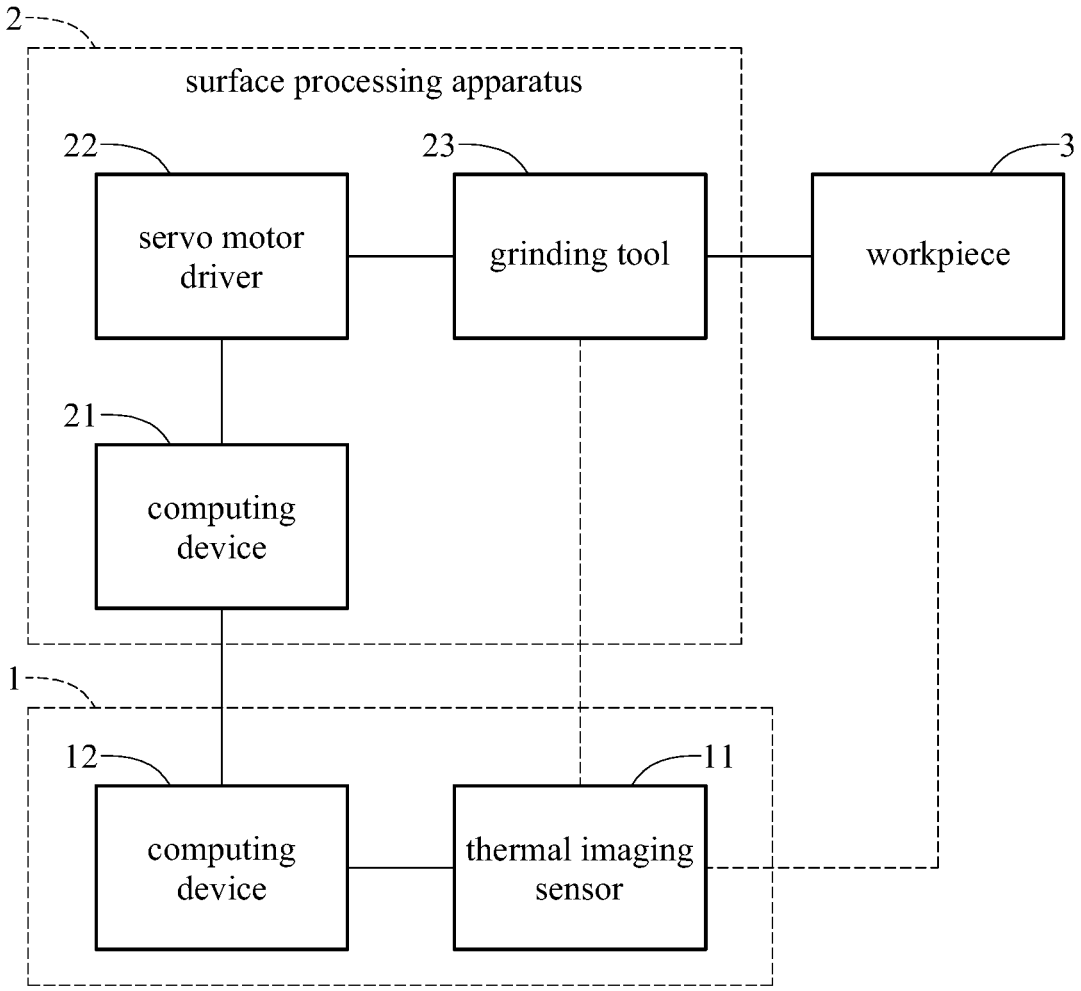
FIG. 1 is a block diagram illustrating the application of a thermal image surface processing auxiliary system according to an embodiment of the present disclosure.

Please refer to FIG. 1 which is a block diagram illustrating the application of a thermal image surface processing auxiliary system according to an embodiment of the present disclosure. As shown in FIG. 1, a thermal image surface processing auxiliary system 1 is applicable for a surface processing apparatus 2 that uses a grinding tool 23 to perform surface processing on at least one workpiece 3. The thermal image surface processing auxiliary system 1 includes a thermal imaging sensor 11 and a computing device 12. The thermal imaging sensor 11 is configured to photograph at least one of the grinding tool 23 and the workpiece 3 to generate at least one thermal image. The computing device 12 is connected to the thermal imaging sensor 11 and is configured to obtain a temperature change of an observation area in the at least one thermal image. When the temperature change is not greater than a preset critical value, the computing device 12 controls the surface processing apparatus 2 to move the grinding tool 23 toward the workpiece 3 at a first preset speed greater than a preset processing speed. When the temperature change is greater than the preset critical value, the computing device 12 controls the surface processing apparatus 2 to move the grinding tool 23 toward the at least one workpiece 3 at the preset processing speed, wherein the observation area corresponds to a portion other than a contact portion of the grinding tool 23 with the workpiece 3.

The thermal image surface processing auxiliary system 1 of the present disclosure may be applied to various surface processing apparatus 2, such as grinders, wafer grinding equipment, wafer polishing equipment, lathes, milling machines, etc., that may be equipped with computer numerical control (CNC) software. In particular, any equipment that controls the grinding tool to directly contact the workpiece for grinding and causes the surface of at least one of the grinding tool and the workpiece to heat up due to friction during the process may be called a surface processing apparatus 2 described herein. As can be understood by those with ordinary knowledge in the art, the present disclosure may only describe the minimum necessary elements of the surface processing apparatus 2 that are directly related to the technical concept of the present disclosure for convenient explanation without affecting the completeness of the description of the present disclosure. Similarly, the workpiece 3 may be a component to be processed applicable for various surface processing apparatus 2, such as a wafer. In addition, the present disclosure does not have any limitation on the material and quantity of the grinding tool 23 and the workpiece 3.

In the present embodiment, the thermal imaging sensor 11 of the thermal image surface processing auxiliary system 1 may be an infrared thermal imaging sensor, which is used to receive infrared rays emitted by an object surface to generate a thermal image, and may continuously photograph at least one of the grinding tool 23 and the workpiece 3 and obtain thermal images. The sampling rate of the thermal imaging sensor 11 may be capturing 9 thermal images per second, and the temperature resolution of the thermal image may be 0.05 degrees Celsius. The computing device 12 of the thermal image surface processing auxiliary system 1 may be a computer with functions of data receiving, data recording, data computing, data storage and data output. For example, the computing device 12 is composed of a microcontroller, a central processing unit, a programmable logic controller, a memory, an input/output interface, a communicator, etc., and is configured to obtain the thermal image captured by the thermal imaging sensor 11 and calculate and obtain the temperature or temperature change corresponding to the observation area in the thermal image. The observation area is a preset parameter of the computing device 12. The thermal imaging sensor 11 and the computing device 12 may be connected in a wired or wireless manner. Referring to the configuration of FIG. 1, the thermal imaging sensor 11 may be configured to capture a thermal image of an area corresponding to at least one of the grinding tool 23 and the workpiece 3. Specifically, the image capturing range of the thermal imaging sensor 11 must include at least a portion corresponding to the preset observation area of the computing device 12. In particular, the thermal imaging sensor 11 may specifically photograph the non-contact portion of the grinding tool 23 with the workpiece 3 to generate a thermal image. In addition, the present disclosure does not have limitation on the installation position and photographing position of the thermal imaging sensor 11, and in some embodiments, the number of thermal imaging sensors 11 may be multiple.

When the thermal imaging sensor 11 generates a thermal image, the computing device 12 may obtain the thermal image, calculate and obtain the temperature change (thermal temperature rise) of an observation area in the thermal image, and determine whether the temperature change is greater than a preset critical value. When the computing device 12 determines that the temperature change is not greater than the preset critical value, the computing device 12 may send a control command to the controller 21 of the surface processing machine 2 to control a servo motor driver 22 so that the grinding tool 23 moves towards workpiece 3 at a speed greater than a preset processing speed. When the computing device 12 determines that the temperature change is greater than the preset critical value, the computing device 12 may send a control command to the controller 21 of the surface processing machine 2 to control the servo motor driver 22 so that the grinding tool 23 moves towards workpiece 3 at a speed of the preset processing speed. The servo motor driver 22 described above may be used to adjust the displacement of the grinding tool 23 in various axial directions, especially the displacement toward the workpiece 3. The computing device 12 and the controller 21 may be connected in a wired or wireless manner. It should be noted that FIG. 1 illustrates an example that the computing device 12 and the controller 21 are different devices. In another embodiment, the computing device 12 may be implemented by writing a software for determining temperature changes and corresponding control speed as described above into the controller of the surface processing machine.

Figure 2:
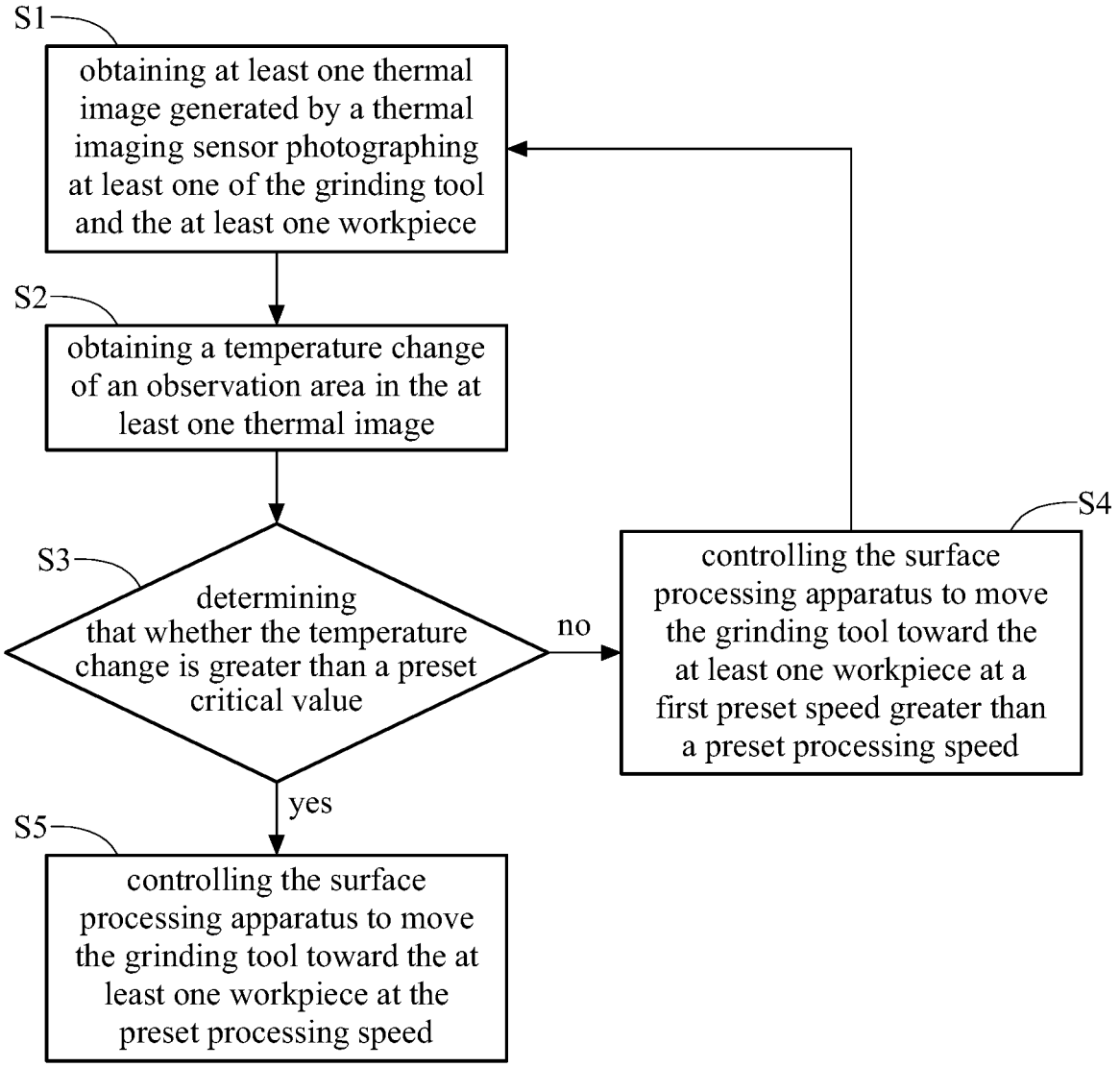
FIG. 2 is a flow chart of a thermal image surface processing auxiliary method according to an embodiment of the present disclosure.

Please refer to FIG. 2 along with FIG. 1, FIG. 2 is a flow chart of a thermal image surface processing auxiliary method according to an embodiment of the present disclosure. As shown in FIG. 2, a thermal imaging surface processing auxiliary method includes executed by a computing device: step S1: obtaining at least one thermal image generated by a thermal imaging sensor photographing at least one of the grinding tool and the at least one workpiece; step S2: obtaining a temperature change of an observation area in the at least one thermal image; step S3: determining that whether the temperature change is greater than a preset critical value; when the temperature change is not greater than the preset critical value, executing step S4: controlling the surface processing apparatus to move the grinding tool toward the at least one workpiece at a first preset speed greater than a preset processing speed; and when the temperature change is greater than the preset critical value, executing step S5: controlling the surface processing apparatus to move the grinding tool toward the at least one workpiece at the preset processing speed. The observation area corresponds to a portion other than a contact portion of the grinding tool with the at least one workpiece.

In step S1, the computing device 12 may obtain one or more thermal images generated by the thermal imaging sensor 11 photographing at least one of the grinding tool 23 and the workpiece 3. For example, the thermal imaging sensor 11 may photograph one or more portions corresponding to the grinding tool 23 and the workpiece 3 to generate corresponding thermal images. In step S2, the computing device 12 may obtain the temperature change of an observation area in the at least one thermal image, wherein the observation area corresponds to a portion other than the contact portion of the grinding tool 23 with the workpiece 3.

Figure 3A:
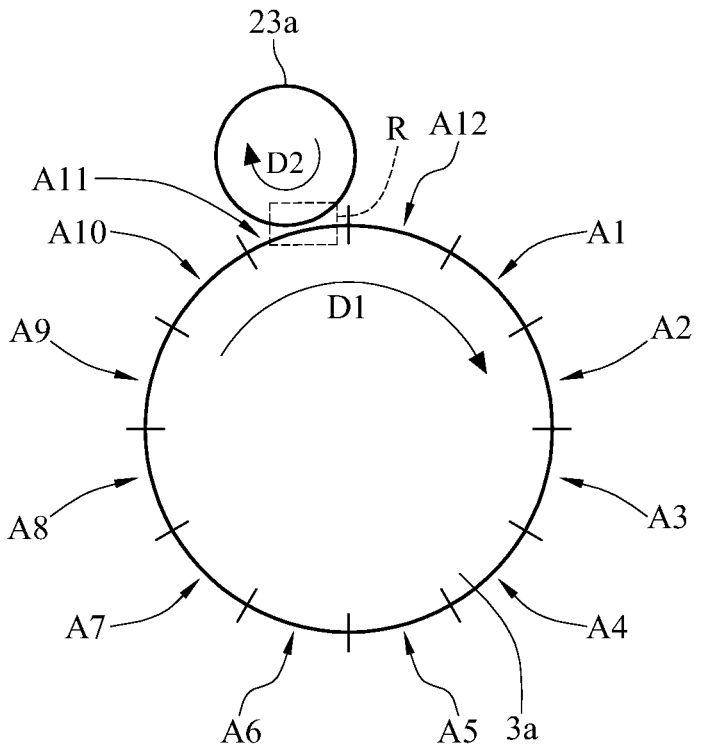
FIGS. 3*a* and 3*b* illustrate an implementation of step S2 of the thermal image surface processing auxiliary method and a corresponding temperature change chart according to an embodiment of the present disclosure.
Figure 3B:
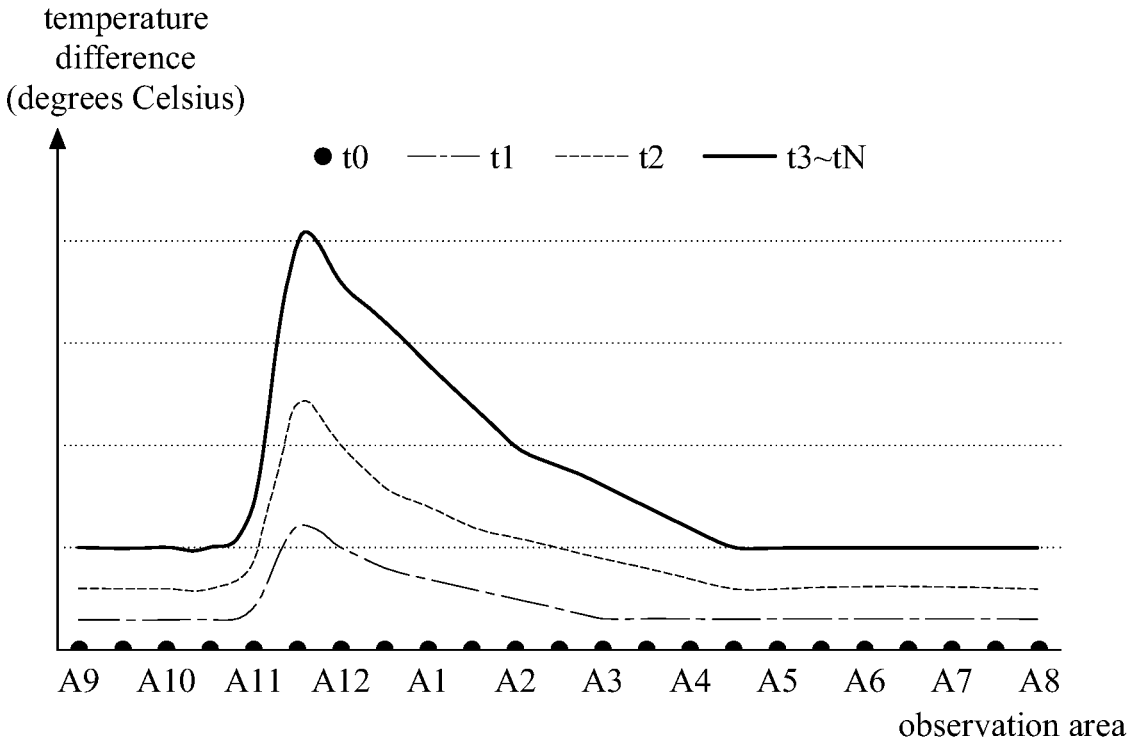

Please refer to FIGS. 3*a* and 3*b* along with FIG. 2, FIGS. 3*a* and 3*b* illustrate an implementation of step S2 of the thermal image surface processing auxiliary method and a corresponding temperature change chart according to an embodiment of the present disclosure. As shown in FIG. 3*a*, in this embodiment, the grinding tool is a grinding wheel 23*a*, which is used for grinding the workpiece 3*a*. The cylindrical workpiece 3*a* has a rotation direction D1, and the grinding wheel 3*a* has a rotation direction D2. In the processing state, the grinding wheel 23*a* may contact the workpiece 3*a* in a linear processing area (contact portion R). In this embodiment, the thermal imaging sensor may capture images of a plurality of local areas A1 to A12 corresponding to the processing surface of the workpiece 3*a*, and the computing device may obtain the temperature changes of the plurality of local areas A1 to A12 in the thermal image.

As shown in FIG. 3*b*, the temperature changes of these local areas A1 to A12 may be different, and the computing device may use the temperature change of a specific one of the local areas A1 to A12 (ie, the observation area) as an indicator to determine whether the grinding wheel 23*a* is in contact with the workpiece 3*a*. For example, the computing device may obtain an image area corresponding to the contact portion in the at least one thermal image, and use an area adjacent to the image area as the observation area. Specifically, the contact portion of the grinding wheel 23*a* with the workpiece 3*a* corresponds to the local area A11, and the rotation direction D1 is a clockwise direction, then the computing device may be set to obtain the local areas A12, A1 or A2 extending along the rotation direction D1 as the observation area, which is adjacent to the local area A11. By selecting an adjacent area that is extended from the image area corresponding to the contact portion along a specific direction (i.e., the direction of rotation), the observation area that has significant temperature change and is less affected by environmental changes caused by processing may be preferably selected, so that the temperature change may be used as an indicator to determine whether the grinding tool and the workpiece are in contact. Also, in addition to being configured to select the area extending from the image area corresponding to the contact portion and along a specific direction (rotation direction), the computing device may also recognize the image area corresponding to the contact portion of the grinding wheel 23*a* with the workpiece 3*a* through a recognition module with machine vision capabilities, and determine the rotation direction D1 of the workpiece 3*a*.

In one embodiment, before step S1, the computing device may be further configured to obtain a plurality of thermal images from the thermal imaging sensor before obtaining the observation area, and obtain temperature changes of a plurality of local areas in the plurality of thermal images, and record one of the plurality of local areas having a temperature change greater than a preset change. Specifically, the computing device may obtain a plurality of thermal images generated at a plurality of time points from the thermal imaging sensor before determining the observation area, and use these thermal images to determine the observation area. Furthermore, the computing device may perform an idle stroke (no contact between the grinding tool and the workpiece) and a processing stroke (having contact between the grinding tool and the workpiece) with the grinding tool and workpiece applied in steps S1 to S5 or the grinding tool and workpiece of the same type through controlling the surface processing apparatus, and obtain a plurality of thermal images generated by photographing at least one of the grinding tools and workpieces during the idle stroke and processing stroke through the thermal imaging sensor, wherein each of the plurality of thermal images has a plurality of local areas. The computing device may obtain the temperature changes of the plurality of local areas of each thermal image and record a relationship curve between the temperature changes and the local areas. Take FIGS. 3*a* and 3*b* as an example, the computing device may obtain a plurality of thermal images at time t0, t1, t2 and t3~tN respectively and record the temperature changes of the local areas A1 to A12, so as to obtain one of the local areas A1 to A12 that has a temperature change greater than a preset change for subsequent determination. Next, in step S2, the one of the plurality of local areas with the temperature change greater than the preset change is used as the observation area. The preset change may be set according to actual needs. In this embodiment, the computing device may select the local area with a more significant temperature change as the observation area (such as the local area A12, A1 or A2) according to the temperature changes of the local area A1 to A12. In step S3, the computing device may determine whether the temperature change of the specific observation area is greater than a preset critical value. If the computing device determines that the temperature change is not greater than the preset critical value, then in step S4, the computing device may control the surface processing apparatus to move the grinding tool toward the workpiece at a speed greater than the preset processing speed to reduce the time spent on idle stroke. If the computing device determines that the temperature change is greater than the preset critical value, indicating that the grinding tool and the workpiece have started contacting each other, then in step S5, the computing device may control the surface processing apparatus to move the grinding tool toward the workpiece at the preset processing speed to perform fine grinding operations. As shown in FIG. 3*b*, assuming that the computing device uses the local area A12 as the basis for determination, at time t0, the computing device may determine that the temperature change is 0, which indicates that the grinding wheel 23*a* and the workpiece 3*a* have not yet started contacting each other, and control the surface processing apparatus to move the grinding tool toward the workpiece at a speed greater than the preset processing speed. And at time t1, the computing device may determine that the temperature change is greater than the preset critical value, which indicates that the grinding wheel 23*a* and the workpiece 3*a* have started contacting each other, and control the surface processing apparatus to move the grinding tool toward the workpiece at a speed equal to the preset processing speed. The preset critical temperature described above as a criterion may be, for example, 2 degrees Celsius.

Figure 4A:
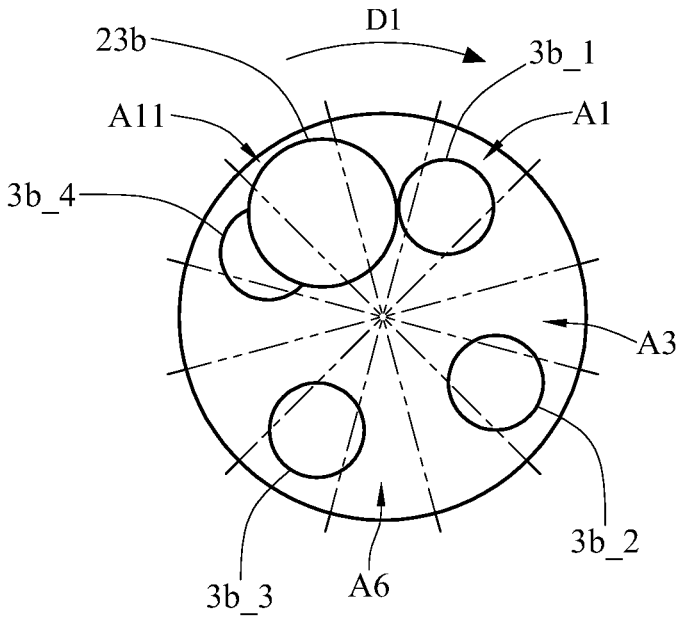
FIGS. 4*a* and 4*b* illustrate another implementation of step S2 of the thermal image surface processing auxiliary method and a corresponding temperature change chart according to an embodiment of the present disclosure.
Figure 4B:
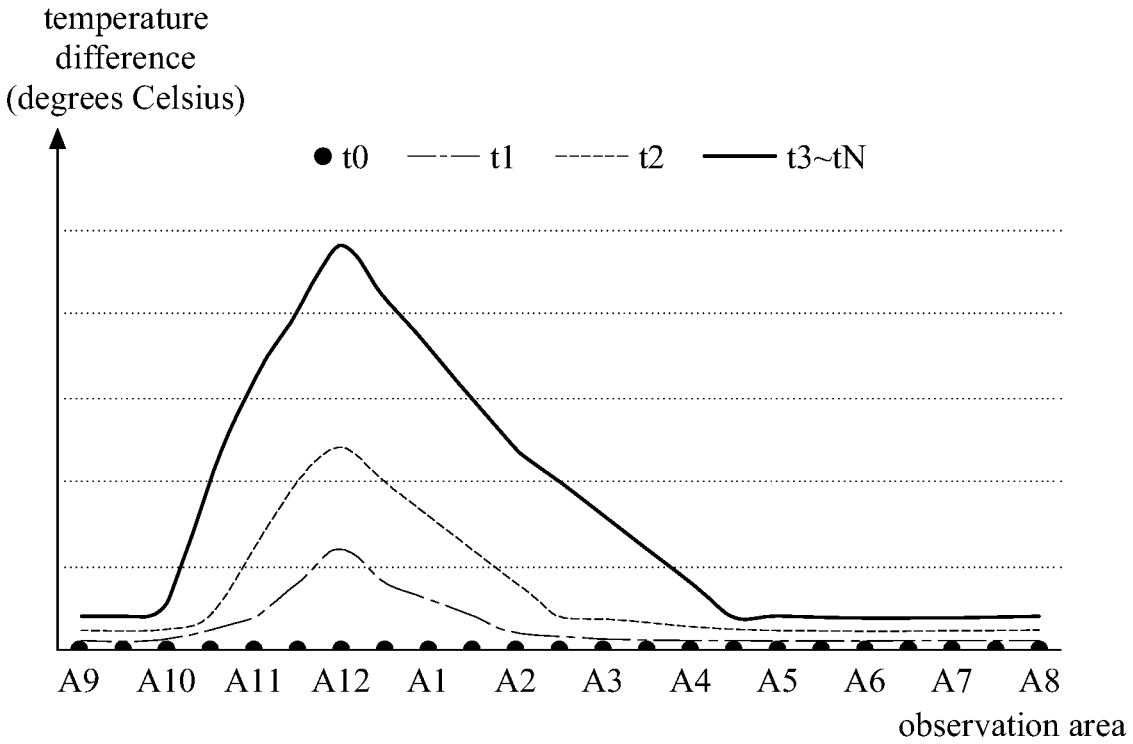

Please refer to FIGS. 4*a* and 4*b* along with FIG. 2, FIGS. 4*a* and 4*b* illustrate another implementation of step S2 of the thermal image surface processing auxiliary method and a corresponding temperature change chart according to an embodiment of the present disclosure. As shown in FIG. 4*a*, in this embodiment, the grinding tool is a grinding wheel 23*b*, which is used to grind a plurality of wafers 3*b*_1, 3*b*_2, 3*b*_3 and 3*b*_4. The rotation stage 24 for carrying the plurality of wafers 3*b*_1, 3*b*_2, 3*b*_3 and 3*b*_4 has a rotation direction D1. In the processing state, the grinding wheel 23*b* may contact the wafer in a surface processing area (contact portion). In the present embodiment, the thermal imaging sensor may capture images of a plurality of local areas A1 to A12 corresponding to the rotating stage 24 (including the wafer), and the computing device may obtain the temperature changes of the plurality of local areas A1 to A12 in the thermal image. As shown in FIG. 4*b*, the temperature changes of these local areas A1 to A12 may be different, and the computing device may use the temperature change of a specific one of the local areas A1 to A12 (ie, the observation area) as an indicator to determine whether the grinding wheel 23*b* is in contact with the wafers 3*b*_1, 3*b*_2, 3*b*_3 and 3*b*_4. Some relevant descriptions are similar to FIGS. 3*a* and 3*b* and are not described again herein. In the present embodiment, before step S1, the computing device may be further configured to obtain a plurality of thermal images, obtain the temperature changes of a plurality of local areas in the plurality of thermal images, and record one of the plurality of local areas having a temperature change greater than a preset change. The relevant description is similar to the previous embodiment and is not repeated herein.

Figure 5A:
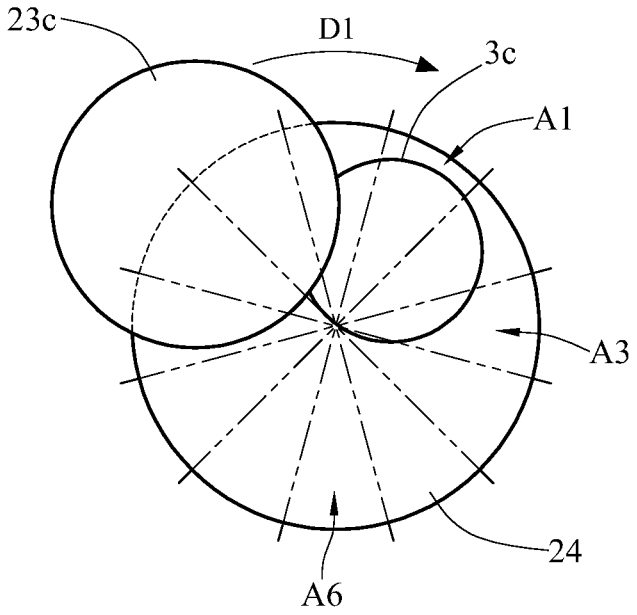
FIGS. 5*a* and 5*b* illustrate still another implementation of step S2 of the thermal image surface processing auxiliary method and a corresponding temperature change chart according to an embodiment of the present disclosure.
Figure 5B:
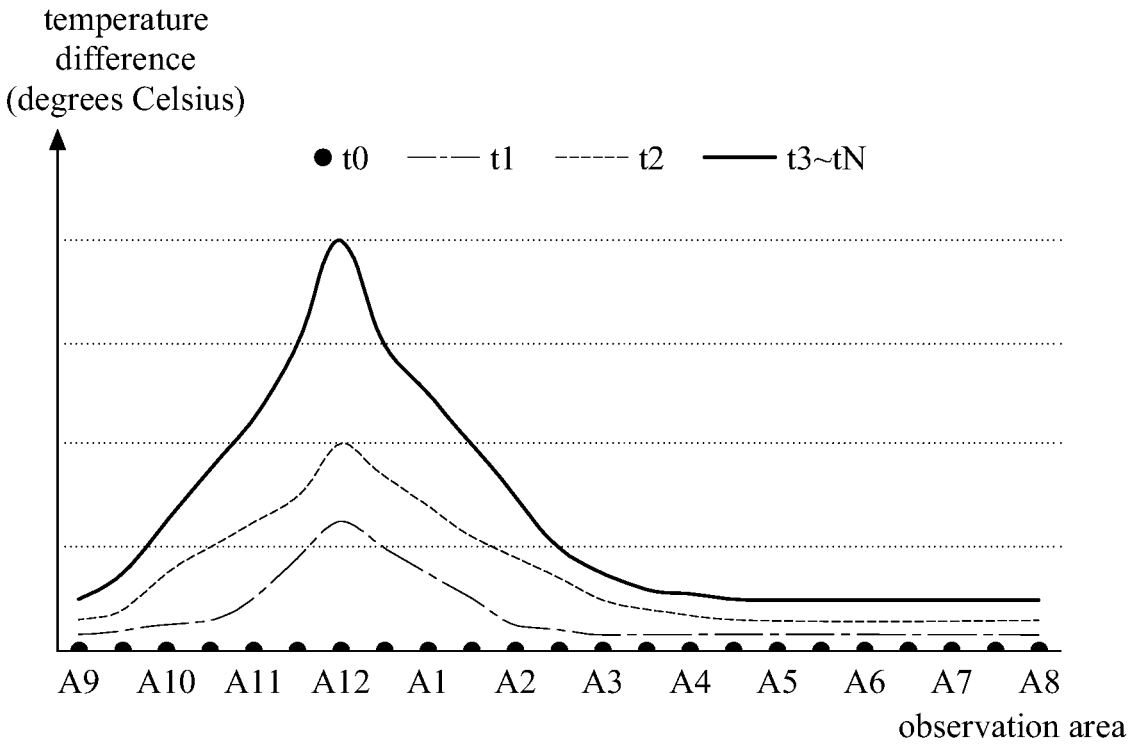

Please refer to FIGS. 5*a* and 5*b* along with FIG. 2, FIGS. 5*a* and 5*b* illustrate still another implementation of step S2 of the thermal image surface processing auxiliary method and a corresponding temperature change chart according to an embodiment of the present disclosure. As shown in FIG. 5*a*, in this embodiment, the grinding tool is a grinding wheel 23*c*, which is used to grind a wafer 3*c*. The rotation stage 24 for carrying the wafer 3*c* has a rotation direction D1. In the processing state, the grinding wheel 23*c* may contact the wafer 3*c* in a surface processing area (contact portion). In the present embodiment, the thermal imaging sensor may capture images of a plurality of local areas A1 to A12 corresponding to the rotating stage 24 (including the wafer), and the computing device may obtain the temperature changes of the plurality of local areas A1 to A12 in the thermal image. As shown in FIG. 5*b*, the temperature changes of these local areas A1 to A12 may be different, and the computing device may use the temperature change of a specific one of the local areas A1 to A12 (ie, the observation area) as an indicator to determine whether the grinding wheel 23*c* is in contact with the wafer 3*c*. Some relevant descriptions are similar to FIGS. 3*a* and 3*b* and are not described again herein. In the present embodiment, before step S1, the computing device may be further configured to obtain a plurality of thermal images, obtain the temperature changes of a plurality of local areas in the plurality of thermal images, and record one of the plurality of local areas having a temperature change greater than a preset change. The relevant description is similar to the previous embodiment and is not repeated herein.

Figure 6:
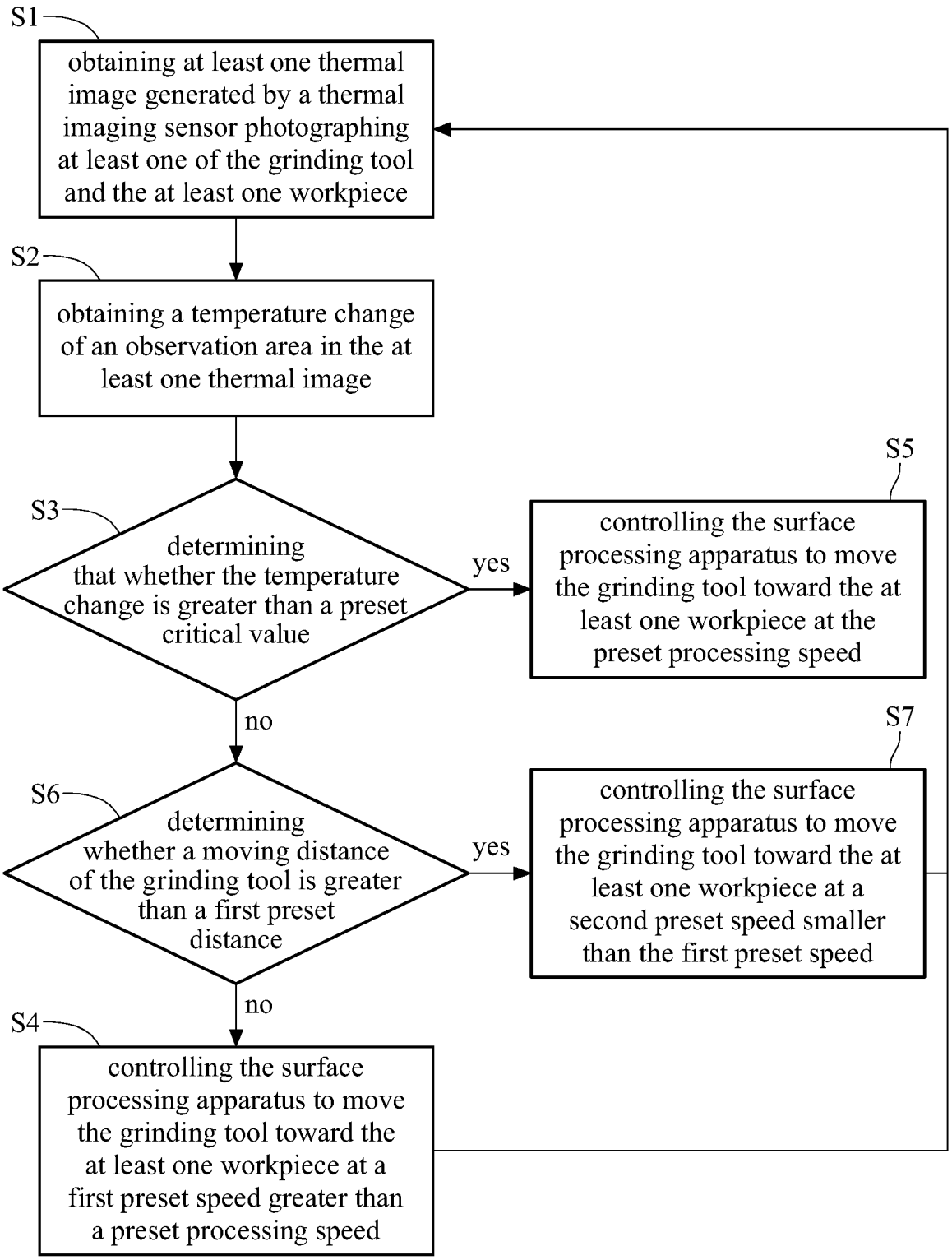
FIG. 6 is a flow chart of a thermal image surface processing auxiliary method according to another embodiment of the present disclosure.

Please refer to FIG. 6 which is a flow chart of a thermal image surface processing auxiliary method according to another embodiment of the present disclosure. As shown in FIG. 6, steps S1 to S5 of the thermal imaging surface processing auxiliary method in the present embodiment are basically the same as the previous embodiment, and are not described again herein. In the present embodiment, when the computing device determines in step S3 that the temperature change is not greater than the preset critical value, the computing device executes step S6: determining whether a moving distance of the grinding tool is greater than a first preset distance; if not, the computing device executes step S4, if it is, the computing device executes step S7: controlling the surface processing apparatus to move the grinding tool toward the at least one workpiece at a second preset speed smaller than the first preset speed, wherein the second preset speed is greater than the preset processing speed.

For example, the first preset speed may be 3 times the preset processing speed, and the second preset speed may be 2 times the preset processing speed. In steps S3 and S5, when it is determined that the temperature change is greater than the preset critical value, indicating that the grinding tool and the workpiece have started contacting each other, the grinding tool is then controlled to move toward the workpiece at the preset processing speed to perform precise processing operation. In steps S6 and S4, when it is determined that the moving distance of the grinding tool is not greater than the first preset distance, indicating that the grinding tool has not moved a sufficient distance during the idle stroke, the surface processing apparatus is then controlled to move the grinding tool toward the workpiece at a highest speed, which is 3 times the preset processing speed, to reduce the advancing time of the idle stroke. In steps S6 and S7, when it is determined that the moving distance of the grinding tool is greater than the first preset distance, indicating that the grinding tool has moved a certain distance during the idle stroke but has not yet contacted the workpiece, the surface processing apparatus is then controlled to move the grinding tool toward the workpiece at a second highest speed, which is 2 times the preset processing speed, to reduce the advancing time of the idle stroke while slightly slowing down the grinding tool to avoid sudden collision between the grinding tool and the workpiece.

Figure 7:
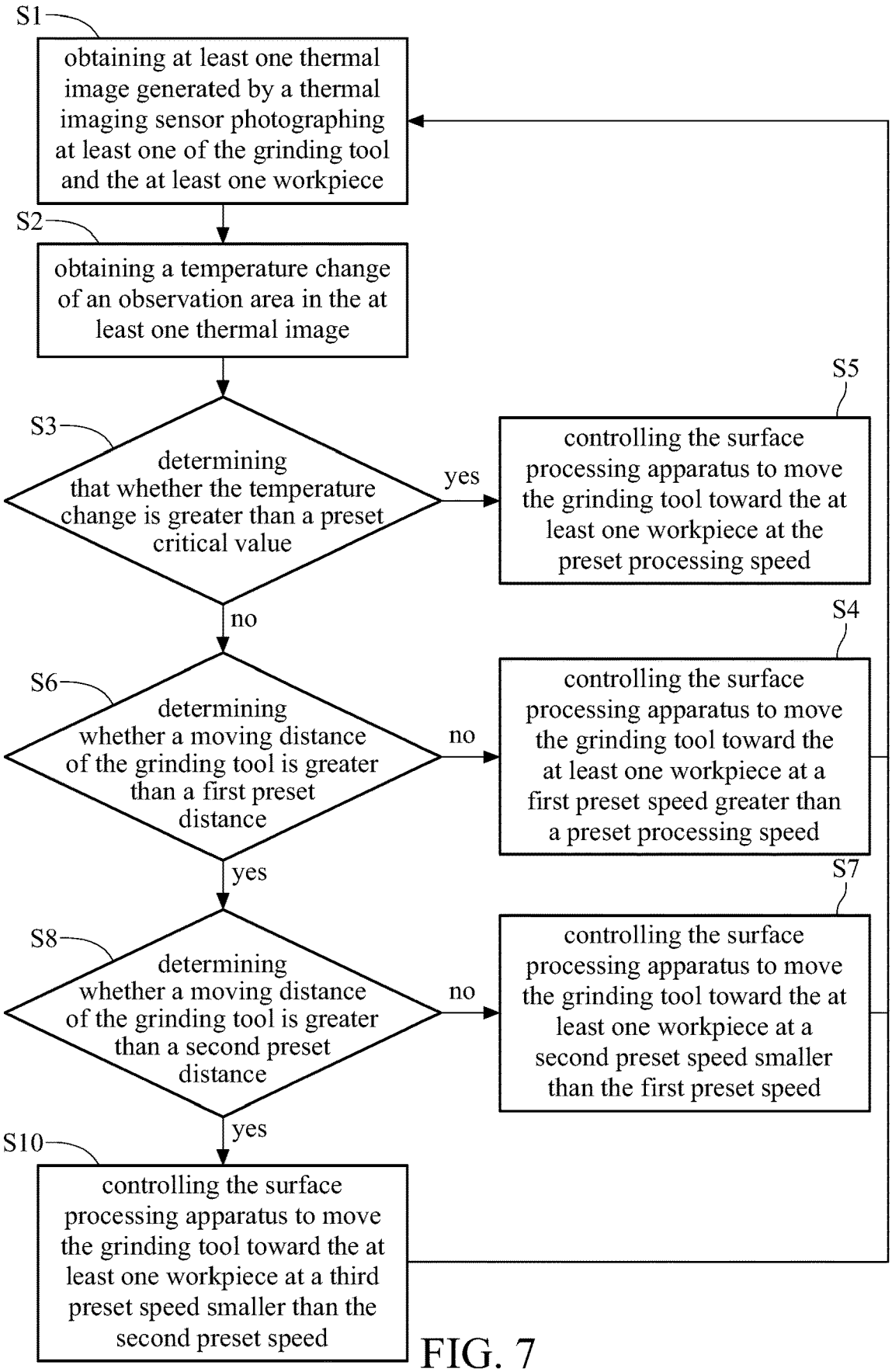
FIG. 7 is a flow chart of a thermal image surface processing auxiliary method according to still another embodiment of the present disclosure.

Please refer to FIG. 7 which is a flow chart of a thermal image surface processing auxiliary method according to still another embodiment of the present disclosure. As shown in FIG. 7, steps S1 to S7 of the thermal imaging surface processing auxiliary method in the present embodiment are basically the same as the previous embodiment, and are not described again herein. In the present embodiment, when the computing device determines in step S6 that the temperature change is not greater than the preset critical value, the computing device executes step S8: determining whether a moving distance of the grinding tool is greater than a second preset distance, wherein the second preset distance is greater than the first preset distance; if not, the computing device executes step S7, if it is, the computing device executes step S10: controlling the surface processing apparatus to move the grinding tool toward the at least one workpiece at a third preset speed smaller than the second preset speed, wherein the third preset speed is greater than the preset processing speed.

For example, the first preset speed may be 3 times the preset processing speed, the second preset speed may be 2 times the preset processing speed, and the third preset speed may be 1.5 times the preset processing speed. In steps S6, S8 and S7, when it is determined that the moving distance of the grinding tool is greater than the first preset distance and smaller than the second preset distance, indicating that the grinding tool has moved a certain distance within a safe range, the surface processing apparatus is then controlled to move the grinding tool toward the workpiece at a second highest speed, which is 2 times the preset processing speed, to reduce the advancing time of the idle stroke while slightly slowing down the grinding tool to avoid sudden collision between the grinding tool and the workpiece. In steps S8 and S10, when it is determined that the moving distance of the grinding tool is greater than the second preset distance, indicating that the grinding tool has moved a certain distance during the idle stroke but has not yet contacted the workpiece, the surface processing apparatus is then controlled to move the grinding tool toward the workpiece at a third highest speed, which is 1.5 times the preset processing speed, to reduce the advancing time of the idle stroke while slightly slowing down the grinding tool to avoid sudden collision between the grinding tool and the workpiece. It should be noted that in the embodiments of FIGS. 2, 6 and 7, as long as it is determined in step S3 that the temperature change is not greater than the preset threshold, the process of obtaining the thermal image of step S1 needs to be re-executed after the steps subsequent to step S3 are executed to continuously determine whether the grinding tool and the workpiece are in contact. That is, after step S4 in the embodiment of FIG. 1 is completed, the computing device should return to execute step S1; after steps S4 and S7 of the embodiment of FIG. 6 are completed, the computing device should return to execute step S1; after steps S4, S7 and S10 of the embodiment of FIG. 7 are completed, the computing device should return to execute step S1.

Figure 8:
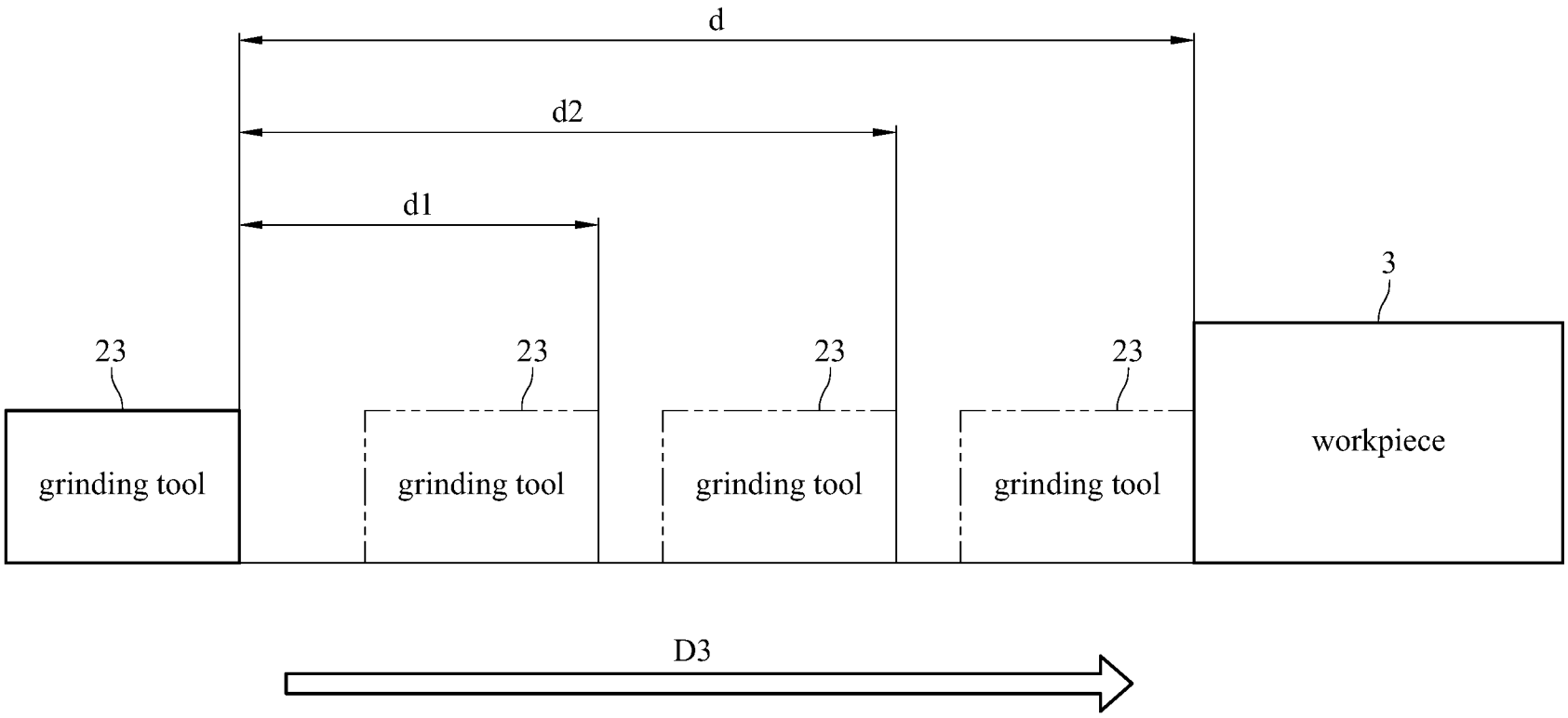
FIG. 8 is a schematic diagram of the processing flow of the thermal imaging surface processing auxiliary method shown in the embodiment of FIG. 7.

Please refer to FIG. 8 which is a schematic diagram of the processing flow of the thermal imaging surface processing auxiliary method shown in the embodiment of FIG. 7. As shown in FIG. 8, there may be a distance d between the grinding tool 23 and the workpiece 3 initially. As the grinding tool 23 is controlled to approach the workpiece 3 along the advancing direction D3 at an advancing speed, which is three times the preset speed, the computing device may change the advancing speed to a speed that is 2 times the preset speed when the moving distance of the grinding tool 23 reaches the first preset distance d1, and change the advancing speed to a speed that is 1.5 times the preset speed when the moving distance of the grinding tool 23 reaches the second preset distance d2. In this way, although the distance d between the grinding tool 23 and the workpiece 3 is difficult to be accurately measured, the time spent on the idle stroke during the advancing process may still be reduced, and at the same time the risk of the grinding tool with a faster speed colliding with the workpiece 3 may also be reduced. It should be noted that in the embodiment of FIGS. 7 and 8, the thermal image surface processing auxiliary method includes performing a two-stage determination on the moving distance of the grinding tool after determining that the temperature change is not greater than the preset critical value, and the advancing speed of the grinding tool is adjusted accordingly. Furthermore, this embodiment may also be applied to more stages of the determination process. For example, between steps S8 and S10, steps of determining whether the moving distance of the grinding tool is greater than a third preset distance, a fourth preset distance . . . etc. may be optionally included, and the repeated description is omitted herein.

Figure 9:
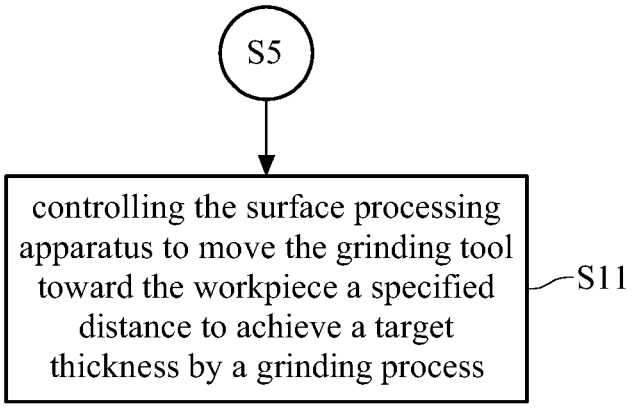
FIG. 9 is a flow chart of a thermal imaging surface processing auxiliary method according to other embodiments of the present disclosure.

Please refer to FIG. 9 which is a flow chart of a thermal imaging surface processing auxiliary method according to other embodiments of the present disclosure. As shown in FIG. 9, in the present embodiment, the thermal imaging surface processing auxiliary method may further include, executed by the computing device after step S5, step S11: controlling the surface processing apparatus to move the grinding tool toward the workpiece a specified distance to achieve a target thickness by a grinding process. Furthermore, after step S5, the computing device may no longer need to detect thermal temperature rise through the thermal imaging sensor.

Please also refer to FIG. 3*b*, the computing device may determine that the temperature of the observation area begins to change at time t1, and as the grinding tool continues to approach the workpiece, it may be determined that the temperature of the observation area continues to rise at time t2. However, from the subsequent time t3 to tN, the temperature change in the observation area remains the same. That is, as the grinding tool continues to advance toward the workpiece, the temperature in the observation area does not continue to rise, which means that the grinding tool and the workpiece have begun to enter a "thermal stable stage". In the above process, after confirming that the temperature change in the observation area is greater than the preset critical value, the computing device may control the surface processing apparatus to move the grinding tool toward the workpiece a specified distance at the preset processing speed to achieve the target thickness of the workpiece through the grinding process (consistent with FIG. 9). Similarly, the temperature change curve corresponding to time t2 in FIG. 4*b* and FIG. 5*b* indicates that the temperature of the observation area continues to rise, and the temperature change curve corresponding to time t3 to tN indicates that the temperature of the observation area reaches a stable stage.

In view of the above description, the thermal imaging surface processing auxiliary system and method may generate a thermal image by using a thermal imaging sensor to photograph at least one of the grinding tool and the workpiece, and use a computing device to obtain the observation area in the thermal image that corresponds to an area adjacent to the contact area between the grinding tool and the workpiece, and measure the temperature change caused by the heat generated by the friction between the grinding tool and the workpiece to accurately determine whether the grinding tool and the workpiece start to contact each other. Moreover, when it is determined that the temperature change does not exceed the preset critical value, which is equivalent to determining that the grinding tool and the workpiece are not in contact, the idle stroke processing instruction of advancing the grinding tool in a high speed is executed to reduce the processing time; when it is determined that the temperature change exceeds the preset critical value, which is equivalent to determining that the grinding tool and the workpiece start to contact each other, the material removal instruction is executed to meet the corresponding processing parameters of the material removal thickness required for final quality, thereby achieving precise processing results. In addition, when it is determined that the grinding tool is not in contact with the workpiece, multi-stage processing instruction optimization may also be performed based on the advancing distance of the grinding tool to further reduce the processing time of the idle stroke and avoid collision and excessive extrusion between the grinding tool and the workpiece.

What is claimed is:

1. A thermal image surface processing auxiliary system, applicable for a surface processing apparatus that uses a grinding tool to perform surface processing on at least one workpiece, comprising:

a thermal imaging sensor configured to photograph at least one of the grinding tool and the at least one workpiece to generate at least one thermal image;

a computing device connected to the thermal imaging sensor and configured to obtain a temperature change of an observation area in the at least one thermal image, control the surface processing apparatus to move the grinding tool toward the at least one workpiece at a speed greater than a preset processing speed when the temperature change is not greater than a preset critical value, and control the surface processing apparatus to move the grinding tool toward the at least one workpiece at the preset processing speed when the temperature change is greater than the preset critical value, wherein the observation area corresponds to a portion other than a contact portion of the grinding tool with the at least one workpiece, wherein the computing device is further configured to determine whether a moving distance of the grinding tool is greater than a first preset distance when determining that the temperature change is not greater the preset critical value, control the surface processing apparatus to move the grinding tool toward the at least one workpiece at a first preset speed when determining that the moving distance of the grinding tool is not greater than the first preset distance, and control the surface processing apparatus to move the grinding tool toward the at least one workpiece at a speed smaller than the first preset speed when determining that the moving distance of the grinding tool is greater than the first preset distance, and wherein the computing device is further configured to determine whether the moving distance of the grinding tool is greater than a second preset distance when determining that the moving distance of the grinding tool is greater than the first preset distance, control the surface processing apparatus to move the grinding tool toward the at least one workpiece at a second preset speed when determining that the moving distance of the grinding tool is not greater than the second preset distance, and control the surface processing apparatus to move the grinding tool toward the at least one workpiece at a third preset speed smaller than the second preset speed when determining that the moving distance of the grinding tool is greater than the second preset distance, wherein the second preset distance is greater than the first preset distance.

2. The thermal image surface processing auxiliary system of claim 1, wherein the computing device is configured to obtain an image area corresponding to the contact portion in the at least one thermal image, and use an area adjacent to the image area as the observation area.

3. The thermal image surface processing auxiliary system of claim 1, wherein the computing device is further configured to obtain a plurality of thermal images from the thermal imaging sensor before obtaining the observation area, obtain temperature changes of a plurality of local areas in the plurality of thermal images, and use one of the plurality of local areas having a temperature change greater than a preset change as the observation area.

4. A thermal imaging surface processing auxiliary method, applicable for a surface processing apparatus that uses a grinding tool to perform surface processing on at least one workpiece, comprising following steps executed by a computing device:

obtaining at least one thermal image generated by a thermal imaging sensor photographing at least one of the grinding tool and the at least one workpiece;

obtaining a temperature change of an observation area in the at least one thermal image;

controlling the surface processing apparatus to move the grinding tool toward the at least one workpiece at a speed greater than a preset processing speed when determining that the temperature change is not greater than a preset critical value;

controlling the surface processing apparatus to move the grinding tool toward the at least one workpiece at the preset processing speed when determining that the temperature change is greater than the preset critical value, wherein the observation area corresponds to a portion other than a contact portion between the grinding tool and the at least one workpiece;

determining whether a moving distance of the grinding tool is greater than a first preset distance when determining that the temperature change is not greater the preset critical value;

when determining that the moving distance of the grinding tool is not greater than the first preset distance, controlling the surface processing apparatus to move the grinding tool toward the at least one workpiece at the first preset speed;

when determining that the moving distance of the grinding tool is greater than the first preset distance, controlling the surface processing apparatus to move the grinding tool toward the at least one workpiece at a speed smaller than the first preset speed;

determining whether the moving distance of the grinding tool is greater than a second preset distance when determining that the moving distance of the grinding tool is greater than the first preset distance, wherein the second preset distance is greater than the first preset distance;

when determining that the moving distance of the grinding tool is not greater than the second preset distance, controlling the surface processing apparatus to move the grinding tool toward the at least one workpiece at a second preset speed; and when determining that the moving distance of the grinding tool is greater than the second preset distance, controlling the surface processing apparatus to move the grinding tool toward the at least one workpiece at a third preset speed smaller than the second preset speed.

5. The thermal imaging surface processing auxiliary method of claim 4, wherein a step of obtaining a temperature change of an observation area in the at least one thermal image comprising:

obtaining an image area corresponding to the contact portion in the at least one thermal image, and use an area adjacent to the image area as the observation area.

6. The thermal imaging surface processing auxiliary method of claim 4, further comprising following steps:

obtaining a plurality of thermal images from the thermal imaging sensor before obtaining the observation area; and obtaining temperature changes of a plurality of local areas in the plurality of thermal images, and record one of the plurality of local areas having a temperature change greater than a preset change, wherein a step of obtaining a temperature change of an observation area in the at least one thermal image comprises:

using the one of the plurality of local areas having a temperature change greater than the preset change as the observation area.

* * * * *